US009376942B2

(12) United States Patent
Noguchi et al.

(10) Patent No.: US 9,376,942 B2
(45) Date of Patent: Jun. 28, 2016

(54) BAFFLE PLATE STRUCTURE FOR OIL PAN

(75) Inventors: Yukihiro Noguchi, Wako (JP); Shinobu Terauchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 920 days.

(21) Appl. No.: 13/360,824

(22) Filed: Jan. 30, 2012

(65) Prior Publication Data

US 2012/0210971 A1 Aug. 23, 2012

(30) Foreign Application Priority Data

Feb. 17, 2011 (JP) ..... 2011-032607

(51) Int. Cl.
*F01M 1/02* (2006.01)
*F01M 11/00* (2006.01)

(52) U.S. Cl.
CPC ..... *F01M 1/02* (2013.01); *F01M 11/0004* (2013.01); *F01M 2001/0284* (2013.01); *F01M 2011/005* (2013.01); *F01M 2011/007* (2013.01)

(58) Field of Classification Search
CPC ..... F01M 11/02; F01M 1/02; F01M 11/0004; F01M 1/06; F02B 2075/027; F02B 77/13; F02F 7/006; F16C 3/14; F16N 31/006; F16N 31/002
USPC ..... 123/195 C, 196 R; 184/6.5, 106
See application file for complete search history.

(56) References Cited

U.S. PATENT DOCUMENTS 3,653,464 A * 4/1972 Jacobsen et al. ..... 184/6.2
5,465,692 A * 11/1995 Uraki et al. ..... 123/195 C
6,428,699 B1 * 8/2002 Iwata et al. ..... 210/249
6,705,270 B1 * 3/2004 Rau et al. ..... 123/195 C
2006/0219620 A1 10/2006 Suga

FOREIGN PATENT DOCUMENTS

JP 05-36974 Y2 1/1989
JP 02-147810 U 12/1990
JP 4-107431 U 9/1992
JP 05-47316 U 6/1993

(Continued)

OTHER PUBLICATIONS

Japanese Office Action for corresponding JP Application No. 2011-032607, Jan. 29, 2013.

(Continued)

*Primary Examiner* — Lindsay Low
*Assistant Examiner* — Kevin Lathers
(74) *Attorney, Agent, or Firm* — Mori & Ward, LLP

(57) ABSTRACT

A baffle plate structure includes an oil pan, an oil pump, a baffle plate, and a resin oil strainer. The baffle plate is to separate an interior of the oil pan into a crank case side and a oil chamber side. The resin oil strainer includes an inlet portion and a parallel portion. The inlet portion extends toward a bottom surface of the oil pan. The inlet portion has an inlet port for lubricant at a lower part of the inlet portion. The parallel portion extends from the inlet portion in a direction substantially parallel to the baffle plate to introduce the lubricant from the inlet portion to the oil pump. The baffle plate has an opening corresponding to the parallel portion of the resin oil strainer. The parallel portion of the resin oil strainer is disposed so as to close the opening.

17 Claims, 9 Drawing Sheets

(56) References Cited

FOREIGN PATENT DOCUMENTS

| | | |
|---|---|---|
| JP | 09-291807 | 11/1997 |
| JP | 2002-36432 | 12/2002 |
| JP | 2005-226535 | 8/2005 |

OTHER PUBLICATIONS

Chinese Office Action for corresponding CN Application No. 201210010409.2, Jan. 10, 2014.

Chinese Office Action for corresponding CN Application No. 201210010409.2, Aug. 5, 2014.

* cited by examiner

BAFFLE PLATE STRUCTURE FOR OIL PAN

CROSS-REFERENCE TO RELATED APPLICATIONS

The present application claims priority under 35 U.S.C. §119 to Japanese Patent Application No. 2011-32607, filed Feb. 17, 2011, entitled "Baffle Plate Structure". The contents of this application are incorporated herein by reference in their entirety.

BACKGROUND OF THE INVENTION

1. Field of the Invention

The present invention relates to a baffle plate structure.

2. Discussion of the Background

Internal-combustion engines installed in vehicles preferably have a decreased length in the height direction in order to be desirably housed in engine compartments. In addition, oil pans mounted below crank cases (internal-combustion engines) are preferably formed to have a shallow depth.

When the oil pan has a shallow depth, the distance between the oil level of lubricant retained in an oil chamber of the oil pan and a crank shaft decreases. This may cause problems such as splashing of the lubricant caused by the crank shaft, thereby decreasing output of the internal-combustion engine.

Technologies in which a baffle plate is mounted above the oil level of lubricant that is retained in an oil chamber of an oil pan have been proposed. The baffle plate suppresses splashing of lubricant caused by a crank shaft and fluctuation of the oil level of the lubricant (see Japanese Unexamined Patent Application Publication No. 9-291807 and Japanese Examined Utility Model Registration Application Publication No. 5-36974).

SUMMARY OF THE INVENTION

According to one aspect of the present invention, a baffle plate structure includes an oil pan, an oil pump, a baffle plate, and a resin oil strainer. The oil pan is mounted below a crank case. The oil pan has an oil chamber to retain lubricant. The oil pump is to draw the lubricant from the oil chamber and to pump the lubricant into an internal-combustion engine. The baffle plate is to separate an interior of the oil pan into a crank case side and a oil chamber side. The resin oil strainer allows the lubricant drawn from the oil chamber into the oil pump through the resin oil strainer. The resin oil strainer includes an inlet portion and a parallel portion. The inlet portion extends toward a bottom surface of the oil pan. The inlet portion has an inlet port for lubricant at a lower part of the inlet portion. The parallel portion extends from the inlet portion in a direction substantially parallel to the baffle plate to introduce the lubricant from the inlet portion to the oil pump. The baffle plate has an opening corresponding to the parallel portion of the resin oil strainer. The parallel portion of the resin oil strainer is disposed so as to close the opening.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
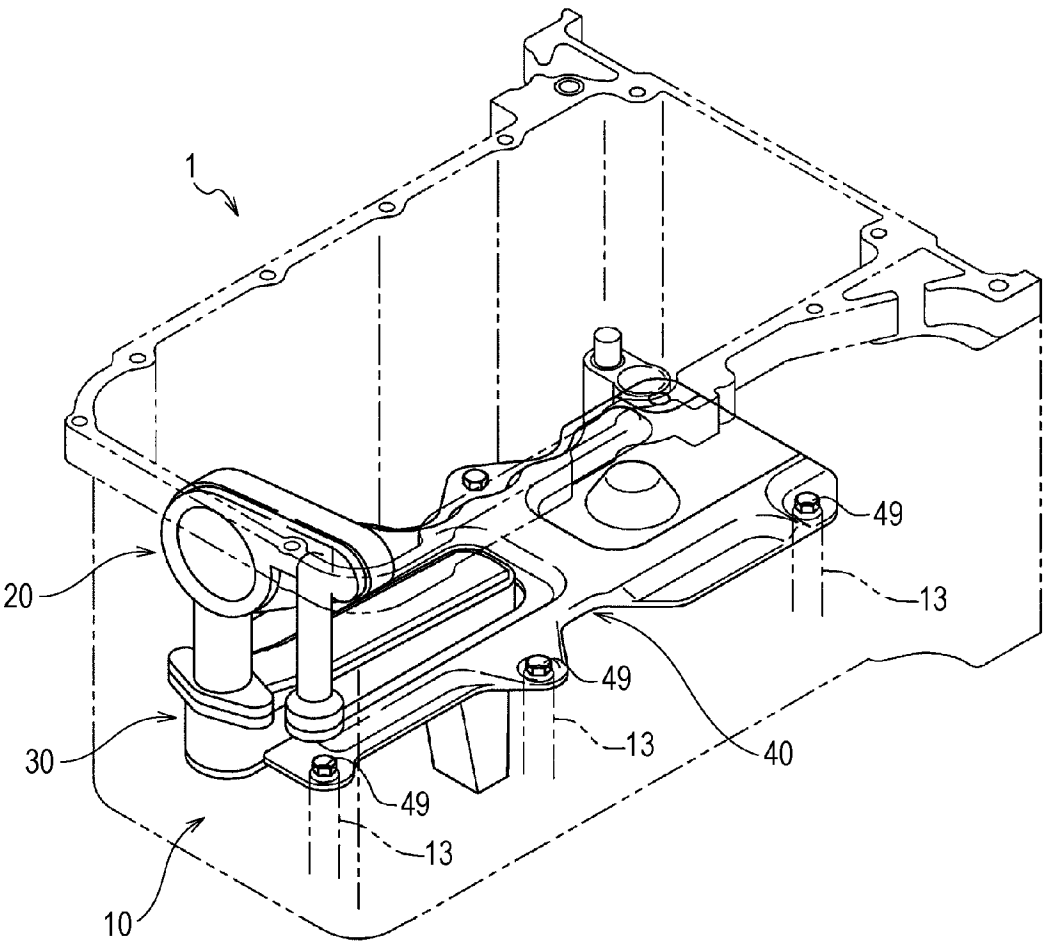
FIG. 1 is a perspective view of a baffle plate structure according to an embodiment.

The embodiments will now be described with reference to the accompanying drawings, wherein like reference numerals designate corresponding or identical elements throughout the various drawings.

An embodiment of the present invention will be described below with reference to FIGS. 1 to 7.

Configuration of Baffle Plate Structure

A baffle plate structure 1 according to the present embodiment includes an oil pan 10, an oil pump 20, an oil strainer 30, and a baffle plate 40. The oil pan 10 is mounted below a crank case 91 (see FIG. 5) and has an oil chamber 11 (see FIG. 3) that retains lubricant. The oil pump 20 draws lubricant from the oil chamber 11 and pumps it into an internal-combustion engine (not shown). The oil strainer 30 is formed of resin and allows the lubricant drawn from the oil chamber 11 into the oil pump 20 to pass therethrough. The baffle plate 40 separates the interior of the oil pan 10 into the crank case 91 side and the oil chamber 11 side.

Oil Pan

The oil pan 10 is formed so as to have a recessed shape (a box shape with the upper side open). The oil chamber 11 is formed in the oil pan 10. In the present embodiment, the internal-combustion engine is transversely disposed in a vehicle. A longitudinal direction of the oil pan 10 is set in a left-right direction (a vehicle width direction) of the vehicle (see FIG. 1). However, the arrangement of the oil pan 10 and the internal-combustion engine is not limited to this and may be modified.

The oil pan 10 has a plurality of bolt boss portions 13 that are formed so as to protrude upward from a bottom surface 12 of the oil pan 10. The bolt boss portions 13 are to be mated with bolts 49 that fasten the baffle plate 40 to the oil pan 10. Each of the bolt boss portions has a bolt hole (a tapped hole). The bolt boss portions 13 as described above have a stiffness higher than those of other portions in the oil pan 10.

Oil Pump

The oil pump 20 is mounted on a left side portion of the crank case 91 with bolts (see FIG. 5), and made to operate together with a crank shaft (not shown). The oil pump 20 has an inlet port 21 for lubricant. The inlet port 21 is open downward in a vertical direction and disposed on a leftmost side of the oil pump 20.

The position of the oil pump 20 is not limited to this and may be modified as appropriate. For example, when secondary balancer shafts are disposed upper and lower sides of the crank shaft in an internal-combustion engine, the oil pump 20 may be disposed on an end side of the lower secondary balancer shaft and operate together with this lower secondary balancer shaft.

Baffle Plate

The baffle plate 40 is a plate-shaped metal component formed by pressing a thin metal sheet. The baffle plate 40 is fastened to the oil pan 10 with the plurality of bolts 49 (see FIG. 5). The baffle plate 40 separates the interior of the oil pan 10 into the crank case 91 side and the oil chamber 11 side and is disposed substantially parallel to the bottom surface 12 of the oil pan 10.

Alternatively, the baffle plate 40 may be fastened to a bottom portion of the crank case 91. Alternatively, the baffle plate 40 may be a plate-shaped component formed of resin. When the baffle plate 40 is formed of resin as described above, the thickness of the baffle plate 40 may be partially increased in order to increase the stiffness of the baffle plate 40.

Figure 2:
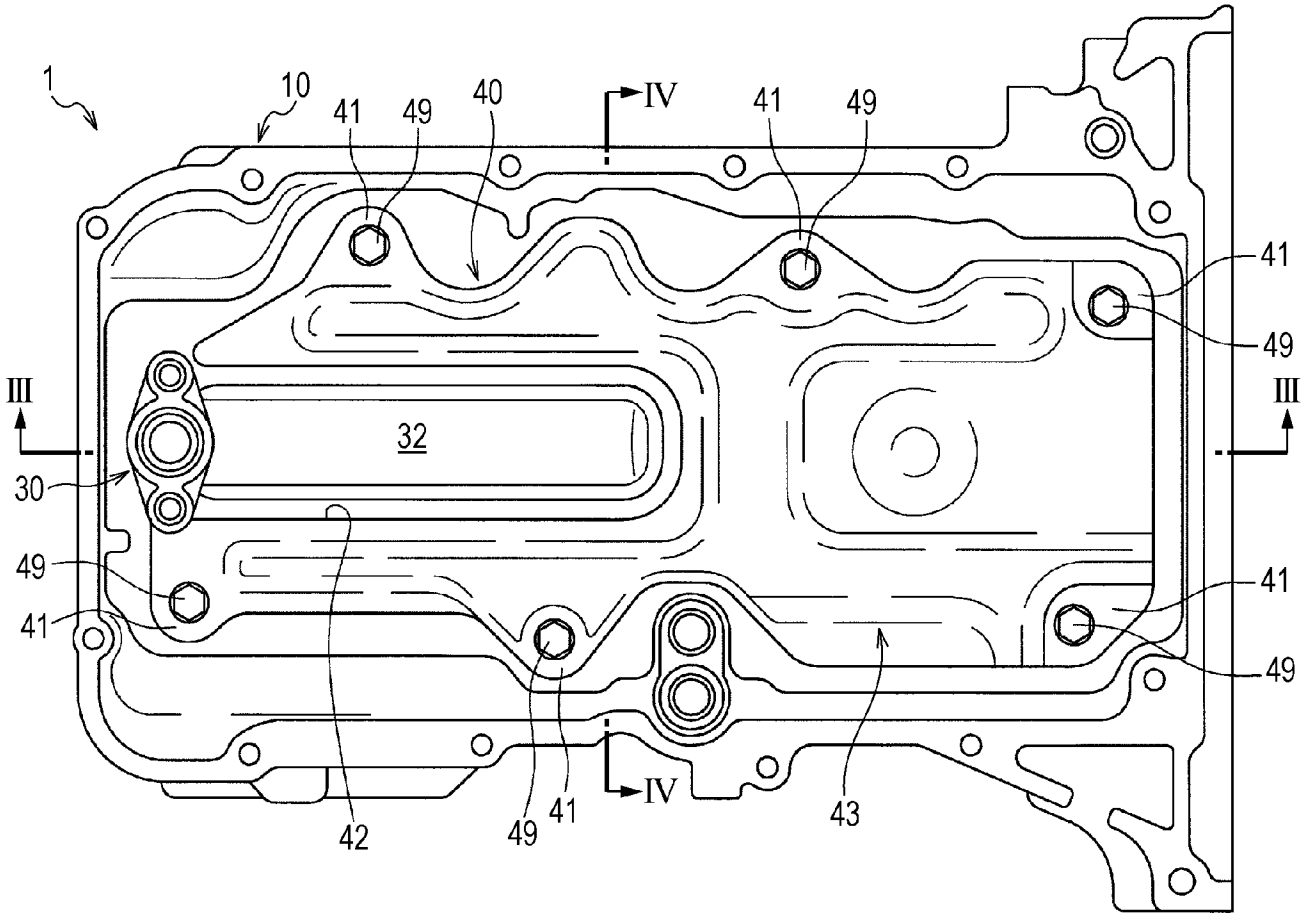
FIG. 2 is a plan view of the baffle plate structure according to the present embodiment.
Figure 7:
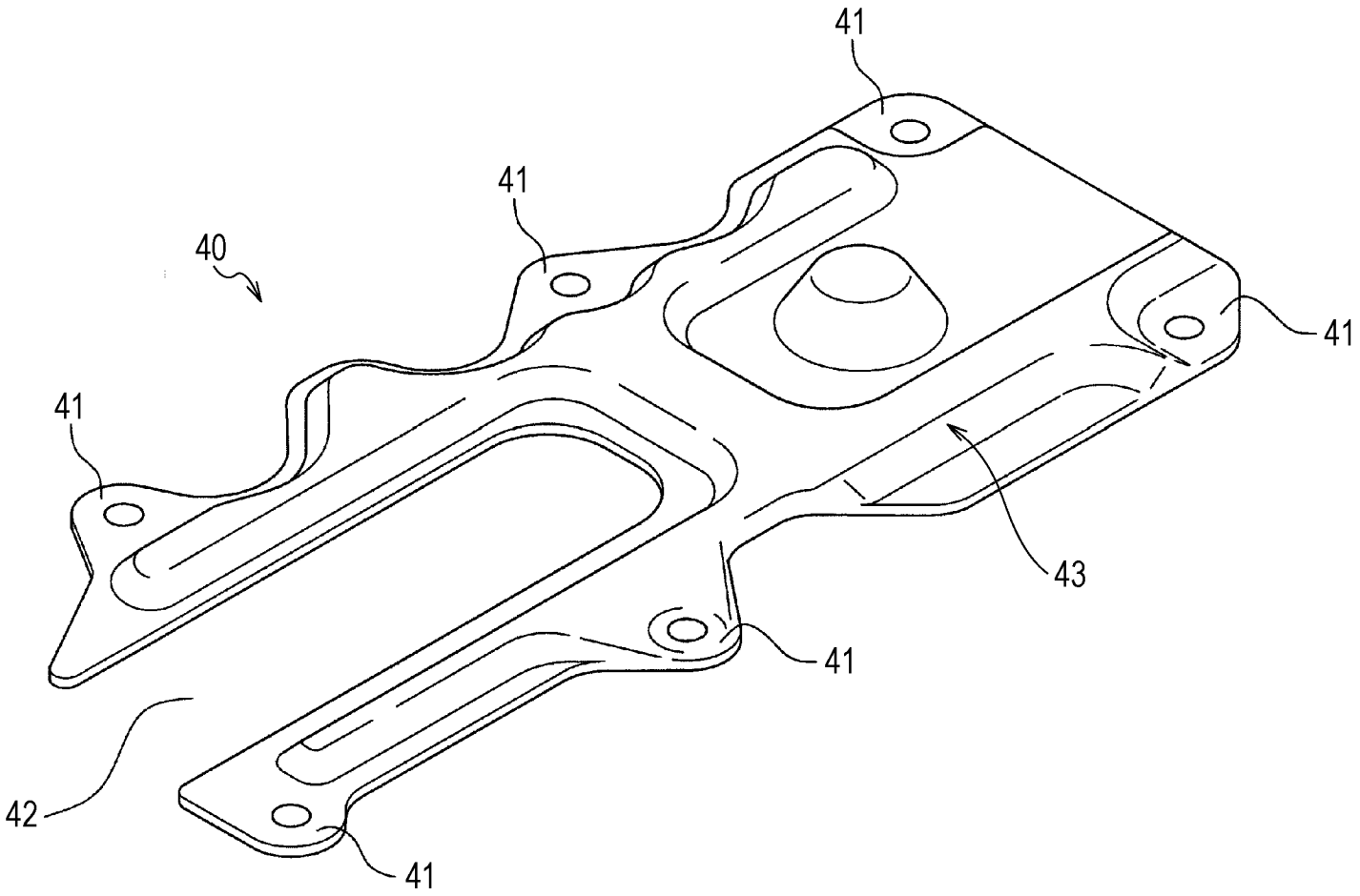
FIG. 7 is a perspective view of a baffle plate according to the present embodiment.

The baffle plate 40 has a plurality of (six in the present embodiment) bolt insertion portions 41 in a peripheral portion thereof (see FIGS. 2 and 7). The bolts 49, which fasten the baffle plate 40 to the oil pan 10, are inserted through the bolt insertion portions 41.

The baffle plate 40 has an elongated cutout portion (opening) that extends from the left side thereof to the central portion thereof in the left-right direction. The cutout portion 42 has a shape that corresponds to an outline shape of a parallel portion 32 of the oil strainer 30, which will be described later.

In addition, the baffle plate 40 has a rib 43 that has a substantially H-shape in plan view. Part of the rib 43 protrudes upward (see FIGS. 2 and 7). The rib 43 is formed so as to surround the cutout portion 42 and connect the plurality of bolt insertion portions 41 to each other. By doing this, when the baffle plate 40 is mounted in the oil pan 10, the rib 43 is disposed so as to connect the bolt boss portions 13 having high stiffness (see FIG. 1) of the oil pan 10 to each other, thereby improving the surface stiffness of the baffle plate 40.

Oil Strainer

The oil strainer 30 having an inverted L-shape in side view is a cylindrically shaped component. A hollow portion, through which lubricant flows, is formed in the oil strainer 30. The oil strainer 30 has an inlet portion 31 and the parallel portion 32. A left part of the parallel portion 32 is fastened to a lower surface of the oil pump 20 with bolts 39 (see FIG. 5). Thus, the oil strainer 30 is secured to the oil pump 20.

Figure 3:
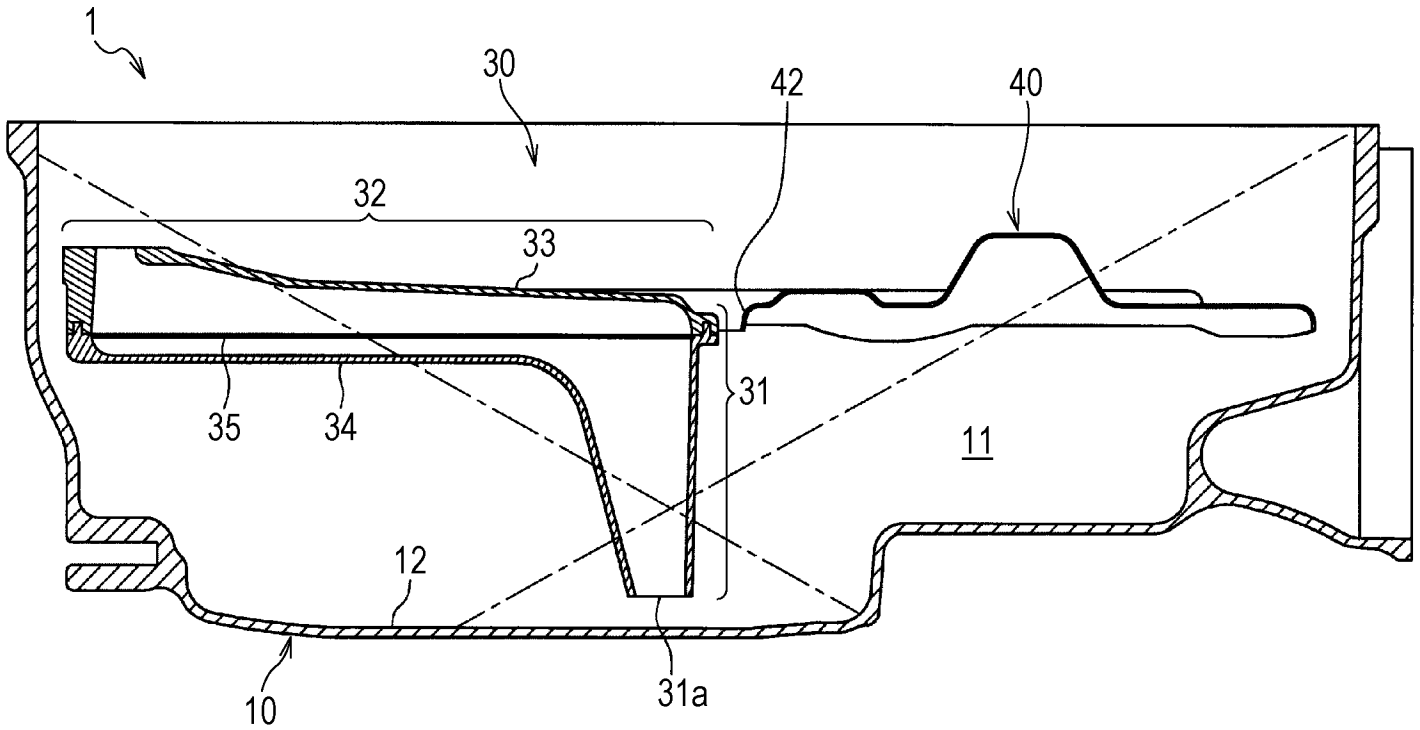
FIG. 3 is a sectional view of the baffle plate structure illustrated in FIG. 2 taken along line III-III in FIG. 2. Dotted chain lines indicate the oil level when a vehicle is inclined toward left and right.
Figure 4:
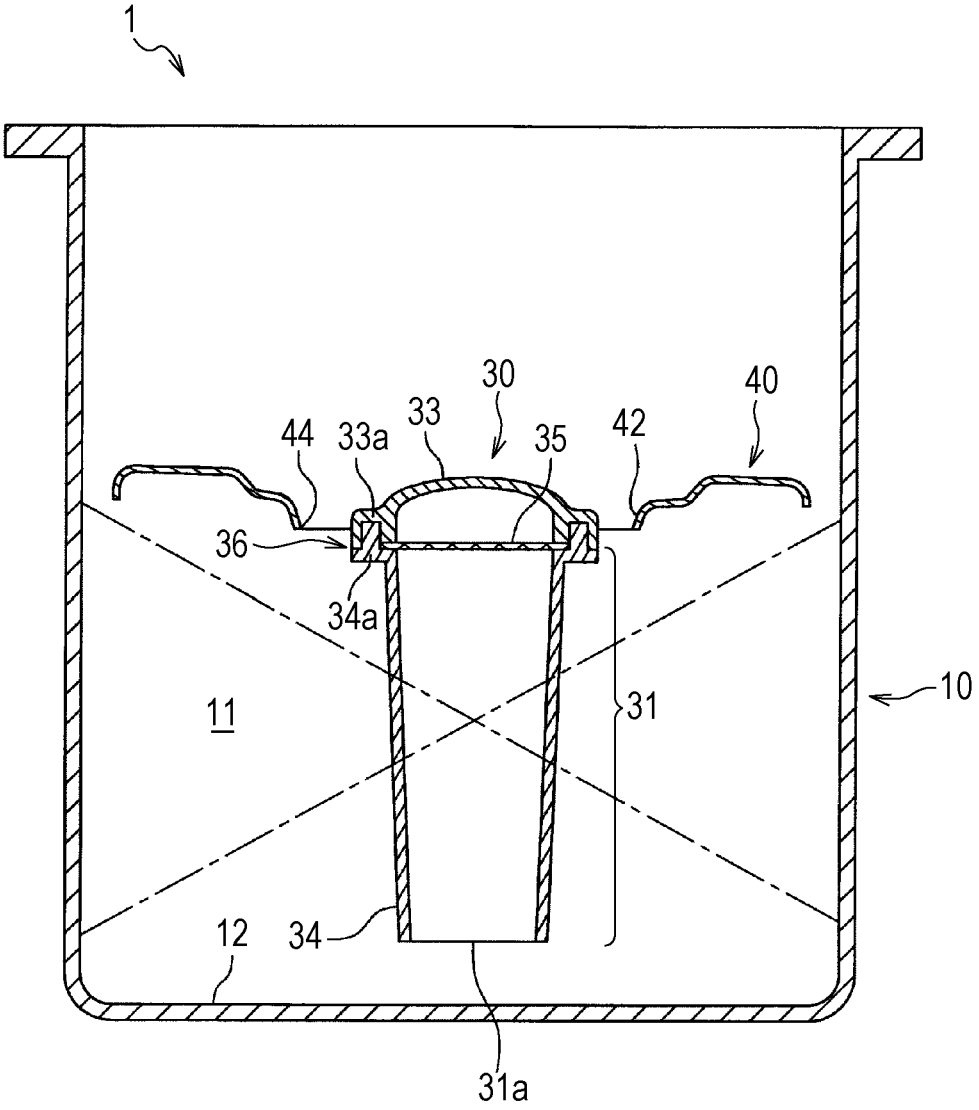
FIG. 4 is a sectional view of the baffle plate structure illustrated in FIG. 2 taken along line IV-IV in FIG. 2. Dotted chain lines indicate the oil level when the vehicle is inclined forward and rearward.
Figure 5:
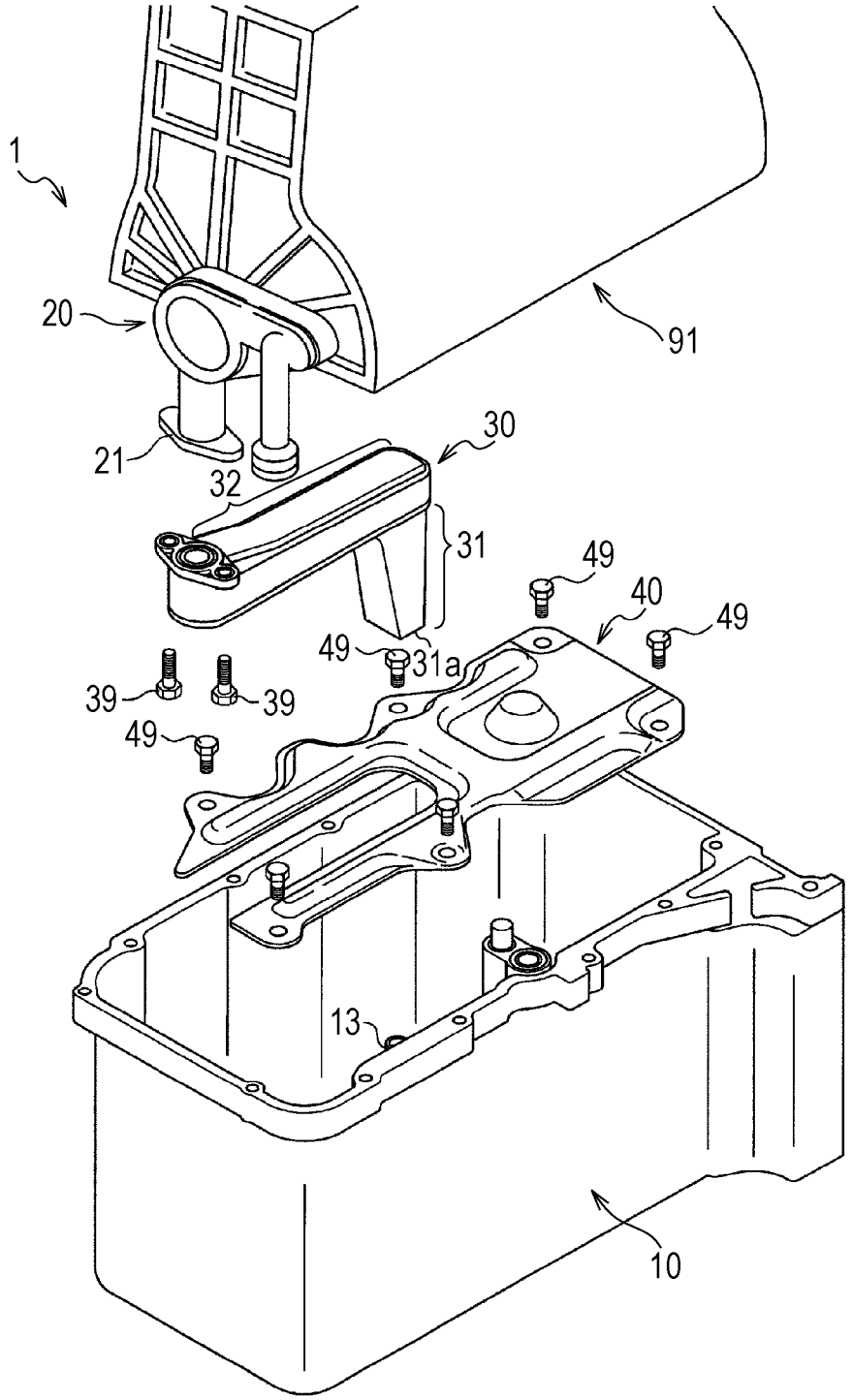
FIG. 5 is an exploded perspective view of the baffle plate structure according to the present embodiment.

The inlet portion 31 vertically extends toward the bottom surface 12 of the oil pan 10. The inlet portion 31 has an inlet port 31*a* for lubricant at its lower end (lower part). In the present embodiment, the inlet port 31*a* is disposed in a substantially central portion of the oil pan 10 in a front-rear direction and the left-right direction (see FIGS. 3 and 4). This allows the inlet port 31*a* to be positioned below the oil level of retained lubricant and allows the lubricant to be drawn even when the vehicle is inclined in one or both of the left-right direction and the front-rear direction. In FIGS. 3 and 4, dotted chain lines indicate the oil level when the vehicle is inclined.

The parallel portion 32 extends from an upper part of the inlet portion 31 in a direction that is substantially parallel to the baffle plate 40, and introduces lubricant from the inlet portion 31 to the inlet port 21 of the oil pump 20.

The parallel portion 32 is disposed so as to close the cutout portion 42 of the baffle plate 40 (see FIG. 2). By doing this, the parallel portion 32 has a function of baffling, that is, the parallel portion 32 suppresses flowing of lubricant from the oil chamber 11 toward an area above the baffle plate 40 and the parallel portion 32. This prevents lubricant from being splashed by the crank shaft and suppresses fluctuation of the oil level of lubricant.

Figure 6:
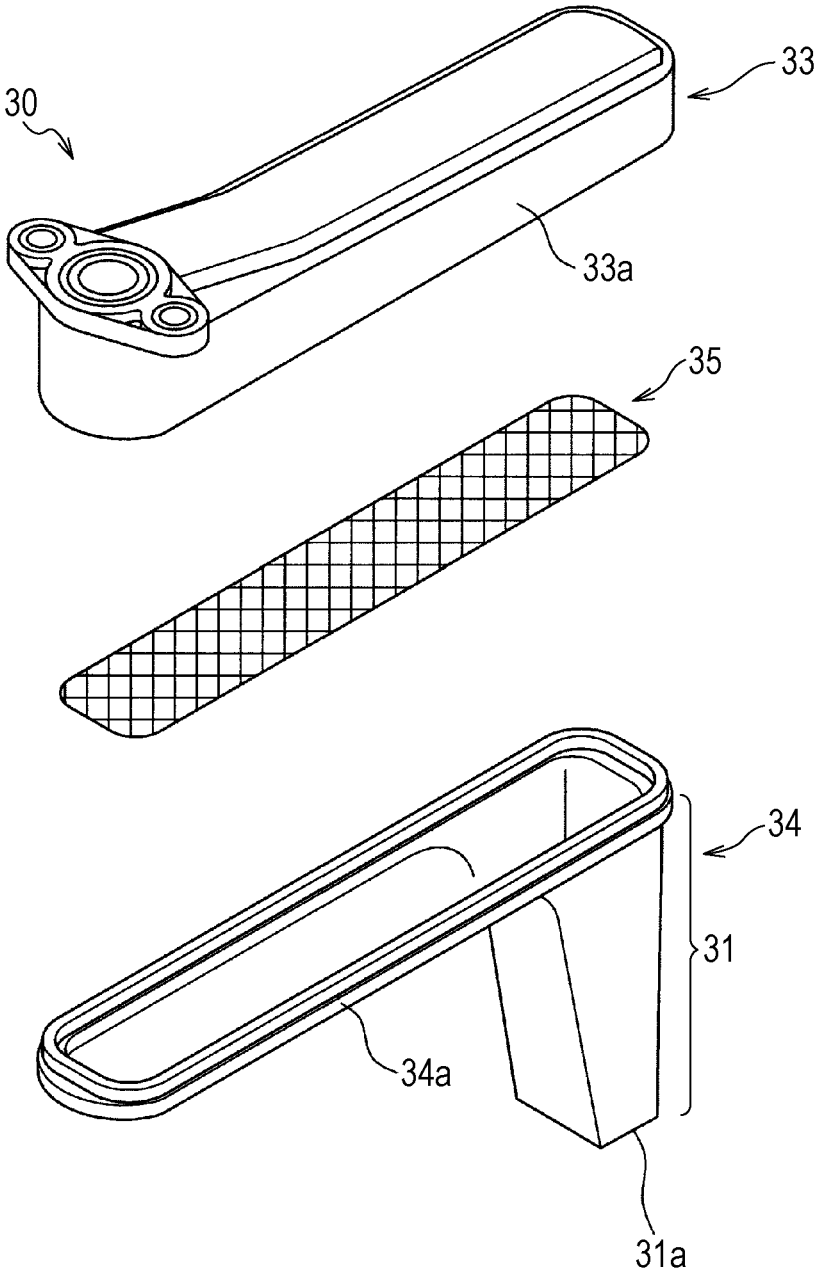
FIG. 6 is an exploded perspective view of an oil strainer according to the present embodiment.

More specifically, as illustrated in FIG. 6, the oil strainer 30 has a three-layer structure that includes an upper half 33, a lower half 34, and a filter 35 (metal wire mesh). The upper half 33 is formed of resin and has a substantially inverted U-shaped section. The lower half 34 is formed of resin, has a substantially U-shaped section, and has a cylindrical portion that serves as the inlet portion 31 at its lower right portion. The filter 35 that filters lubricant is disposed and sandwiched between the upper half 33 and the lower half 34 and extends parallel to the baffle plate 40.

That is, the parallel portion 32 includes the upper half 33 and the lower half 34 (see FIG. 3). The filter 35 that extends in the parallel portion 32 is larger in the left-right direction and has a larger area in a plane direction of the baffle plate 40. By doing this, pressure losses due to the filter 35 are decreased, and the oil pump 20 can desirably draw lubricant.

In particular, a rib 33*a* is formed on an outer peripheral surface of a lower opening of the resin upper half 33. The rib 33*a* outwardly protrudes along a horizontal plane (toward the baffle plate 40). A rib 34*a* is formed on an outer peripheral surface of an upper opening of the resin lower half 34. The rib 34*a* outwardly protrudes along a horizontal plane (toward the baffle plate 40). The upper half 33 and the lower half 34 are integrated into a unit by welding the rib 33*a* and the rib 34*a* to each other.

The rib 33*a* and the rib 34*a* are welded to each other to form a welded rib 36. The welded rib 36 protrudes from the oil strainer 30 side toward the baffle plate 40. The welded rib 36 is disposed at a position closest to an edge 44 surrounding the cutout portion 42 of the baffle plate 40 (see FIG. 4) and closes the cutout portion 42 (opening) of the baffle plate 40. A lower surface of the welded rib 36 (rib 34*a*) also functions as a baffle.

Alternatively, the oil strainer 30 may be an oil strainer that does not have the ribs 33*a* or 34*a*, and accordingly, does not have the protruding welded rib 36.

Operational Advantages of Baffle Plate Structure

With the above-described baffle plate structure 1, the following operational advantages are obtained.

The parallel portion 32 is disposed so as to close the cutout portion 42 of the baffle plate 40. This allows the parallel portion 32 to function as a baffle. The upper half 33 and the lower half 34, which are part of the parallel portion 32, are formed of resin. Thus, the parallel portion 32 that has a suitable shape with regard to the position of the oil pump 20 and that has the inlet port 31*a* at an adequate position can be easily formed, and the length of the parallel portion 32 can be easily increased and decreased.

Since the oil strainer 30 is formed of resin, the weight of the oil strainer 30 is decreased relative to a metal oil strainer. Thus, as described above, it is sufficient that the oil strainer 30 is fastened only to the oil pump 20, and fastening of the oil strainer 30 to a baffle plate, crank case, or the like can be omitted.

In addition, since the rib 43 is formed so as to surround the cutout portion 42 and connect the plurality of bolt insertion portions 41 to each other, the surface stiffness of the baffle plate 40 is improved.

Modifications

Although the embodiment of the present invention has been described above, the present invention is not limited to this and may be modified, for example, as follows.

In the above-described embodiment, an example is described, in which the opening that corresponds to the parallel portion 32 of the oil strainer 30 is the cutout portion 42. Alternatively, the opening may be a hole.

In the above-described embodiment, the size of the parallel portion 32 of the oil strainer 30 in plan view is slightly smaller than that of the cutout portion 42 of the baffle plate 40, and the parallel portion 32 is disposed at substantially the same height as the baffle plate 40 is. That is, in the above-described example, the parallel portion 32 is disposed at substantially on the same plane as the baffle plate 40 is. However, the size of the parallel portion 32 and the positional relationship in the height direction between the parallel portion 32 and the baffle plate 40 are not limited to this.

Figure 8:
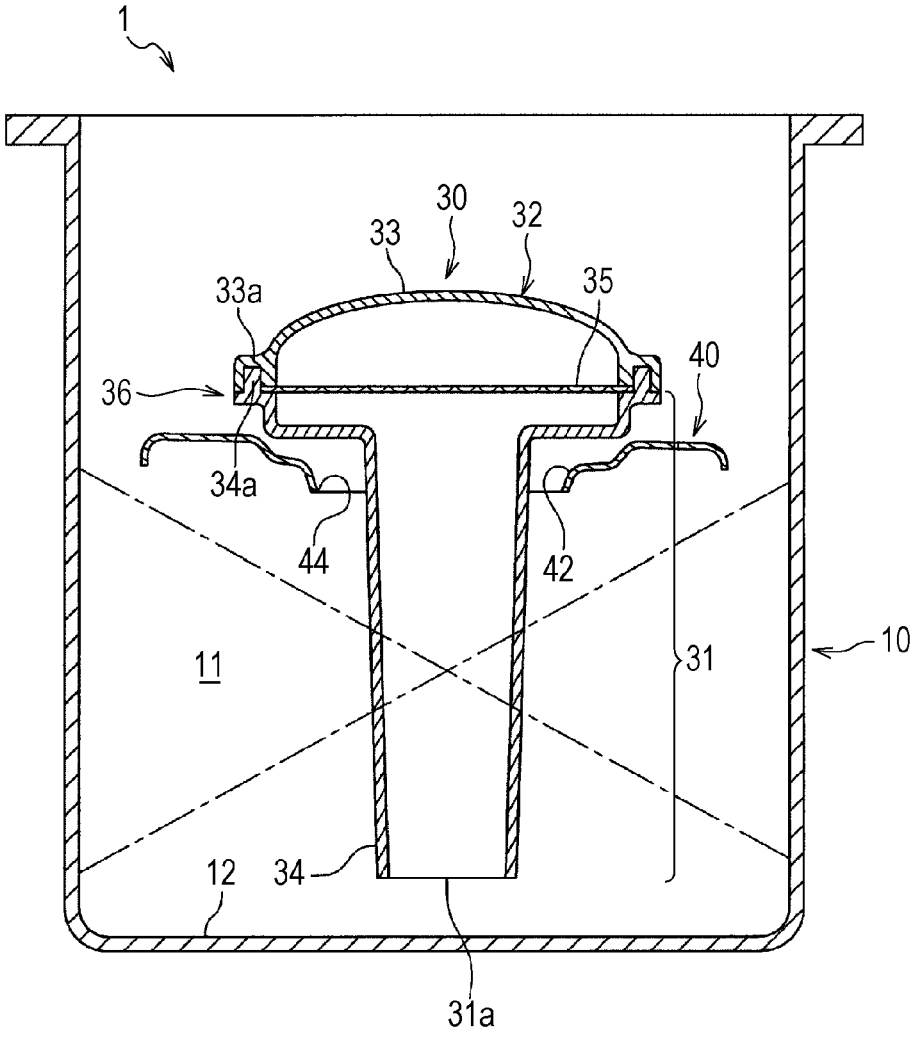
FIG. 8 is a sectional view of a baffle plate structure according to a modification, equivalent to the sectional view taken along line IV-IV in FIG. 2.

For example, the parallel portion 32 may be larger than the cutout portion 42 in the front-rear direction (the up-down direction in FIG. 2 and the left-right direction in FIG. 4) and, as illustrated in FIG. 8, may be disposed above the baffle plate 40 such that the cutout portion 42 is closed from above by the parallel portion 32.

When the size of the parallel portion 32 is increased as described above, the size of the filter 35 is also increased. This can further decrease pressure losses due to the filter 35.

Figure 9:
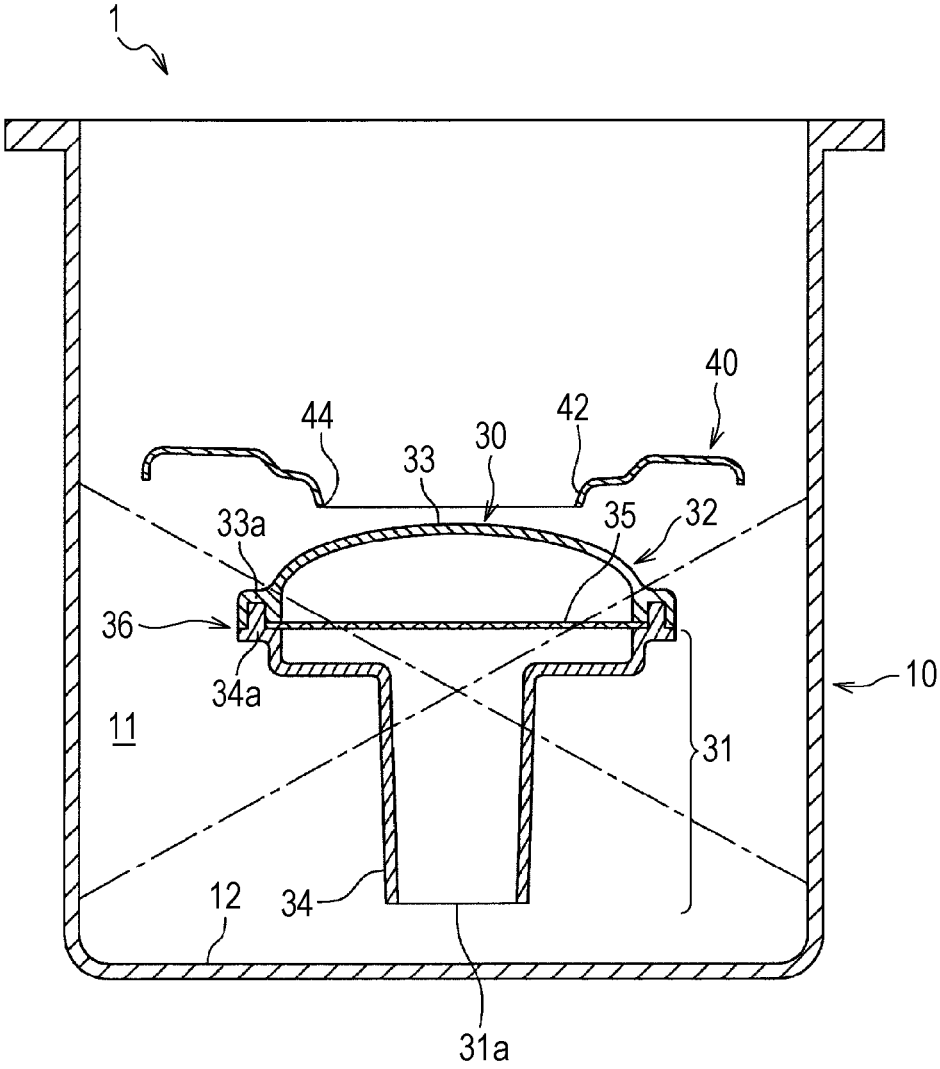
FIG. 9 is a sectional view of a baffle plate structure according to another modification, equivalent to the sectional view taken along line IV-IV in FIG. 2.

Alternatively, as illustrated in FIG. 9, a reversed structure may be used, that is, the parallel portion 32 may be disposed below the baffle plate 40 such that the cutout portion 42 is closed by the parallel portion 32 from below.

The baffle plate structure according to the embodiment of the present invention includes an oil pan that is mounted below a crank case and has an oil chamber that retains lubricant, an oil pump that draws lubricant from the oil chamber and pumps the lubricant into an internal-combustion engine, a resin oil strainer that allows the lubricant, which is drawn from the oil chamber into the oil pump, to pass therethrough, and a baffle plate that separates an interior of the oil pan into the crank case side and the oil chamber side. In the baffle plate structure, the oil strainer includes an inlet portion that extends toward a bottom surface of the oil pan and has an inlet port for lubricant at a lower part thereof, and a parallel portion that extends from the inlet portion in a direction that is substantially parallel to the baffle plate and introduces the lubricant from the inlet portion to the oil pump. In the baffle plate structure, the baffle plate has an opening that corresponds to the parallel portion of the oil strainer, and the parallel portion of the oil strainer is disposed so as to close the opening.

In the baffle plate structure as described above, the parallel portion of the oil strainer is disposed so as to close the opening of the baffle plate. Thus, the parallel portion of the oil strainer has a baffling function. That is, the parallel portion of the oil strainer suppresses flowing of lubricant from the oil chamber toward an area above the baffle plate and the parallel portion of the oil strainer. This can prevent lubricant from being splashed by the crank shaft and suppress fluctuation of the oil level of lubricant using the parallel portion.

The oil strainer having the inlet portion and the parallel portion is formed of resin. Thus, the parallel portion that has a suitable shape with regard to the position of the oil pump and that has the inlet portion at an adequate position can be easily formed, and the length of the parallel portion can be easily increased and decreased. That is, the inlet portion having the inlet port can be desirably laid out in accordance with a recessed shape, a protruding shape, or the like of the bottom of the oil pan.

Since the oil strainer is formed of resin, the weight of the oil strainer is decreased relative to a metal oil strainer. By doing this, for example, as is the case with an embodiment that will be described later, it is sufficient that the oil strainer is fastened only to the oil pump, and fastening of the oil strainer to a baffle plate, crank case, or the like can be omitted. This facilitates assembly of the baffle plate structure.

In addition, since the baffle plate has an opening formed therein, the weight of the baffle plate is also decreased.

Preferably, in the above-described baffle plate structure, the baffle plate has a rib and a plurality of bolt insertion portions. In this case, the rib surrounds the opening, the plurality of bolt insertion portions are portions through which bolts that fasten the baffle plate to the oil pan or the crank case are inserted, and the rib is formed so as to connect the plurality of bolt insertion portions to each other.

Here, in general, bolt boss portions to be mated with the bolts are formed in portions of the oil pan or the crank case to which the baffle plate is fastened. The bolt boss portions each have a bolt hole (a tapped hole). The bolt boss portions have a stiffness higher than those of other portions in the oil pan or the crank case.

In the baffle plate structure as described above, the rib that surrounds the opening is formed so as to connect the plurality of bolt insertion portions to each other. Thus, when the baffle plate is fastened to the oil pan or the crank case, the rib is disposed so as to connect (bridge) the bolt boss portions having high stiffness of the oil pan or the crank case to each other. As a result, the surface stiffness of the baffle plate can be improved.

Preferably, in the above-described baffle plate structure, the parallel portion includes an upper half, a lower half, and a filter that is provided between the upper half and the lower half in a direction substantially parallel to the baffle plate. The filter is a filter through which the lubricant passes.

In the baffle plate structure as described above, the filter that filters the lubricant is disposed in a direction substantially parallel to the baffle plate. Thus, the size of the filter can be increased in a plane direction of the baffle plate corresponding to the opening of the baffle plate. By doing this, pressure losses due to the filter are decreased, and the oil pump can desirably draw lubricant.

Obviously, numerous modifications and variations of the present invention are possible in light of the above teachings. It is therefore to be understood that within the scope of the appended claims, the invention may be practiced otherwise than as specifically described herein.

What is claimed is:

1. A baffle plate structure comprising:

an oil pan mounted below a crank case, the oil pan having an oil chamber to retain lubricant; an oil pump to draw the lubricant from the oil chamber and to pump the lubricant into an internal-combustion engine;

a baffle plate to separate an interior of the oil pan into a crank case side and an oil chamber side; and a resin oil strainer that allows the lubricant drawn from the oil chamber into the oil pump through the resin oil strainer, the resin oil strainer being substantially L-shaped and including an inlet portion and a parallel portion, the inlet portion extending toward a bottom surface of the oil pan to define a height direction of the resin oil strainer, the inlet portion having an inlet port for lubricant at a lower part of the inlet portion, the parallel portion extending from the inlet portion in a direction substantially parallel to the baffle plate and perpendicular to the inlet portion to introduce the lubricant from the inlet portion to the oil pump, the resin oil strainer including a rib that protrudes from an interior side of the resin oil strainer towards the baffle plate, wherein the baffle plate has an opening, the parallel portion of the resin oil strainer being disposed so as to suppress a flow of the lubricant through the opening from the oil chamber side to the crank case side, the rib of the resin oil strainer disposed at a position of the resin oil strainer closest to an edge of the baffle plate surrounding the opening, and wherein the parallel portion includes a first end and a second end, the inlet portion extending from the first end toward the bottom surface of the oil pan, the second end being fastened to the oil pump, a lower surface of the first end and a lower surface of the second end being at a same height in the height direction of the resin oil strainer with respect to the baffle plate.

2. The baffle plate structure according to claim 1, wherein the parallel portion includes an upper half, a lower half, and a filter through which the lubricant passes, the filter being provided between the upper half and the lower half and extending in a direction substantially parallel to the baffle plate.

3. The baffle plate structure according to claim 1, wherein the parallel portion is disposed in the opening of the baffle plate.

4. The baffle plate structure according to claim 1, wherein the baffle plate further has a rib and a plurality of bolt insertion portions, the rib of the baffle plate surrounding the opening, the plurality of bolt insertion portions comprising portions through which bolts are respectively inserted to fasten the baffle plate to one of the oil pan and the crank case, and wherein the rib of the baffle plate is provided to connect the plurality of bolt insertion portions to each other.

5. The baffle plate structure according to claim 1, wherein the opening in the baffle plate is surrounded only on three sides by the baffle plate.

6. The baffle plate structure according to claim 1, further comprising:

a filter, wherein the parallel portion comprises an upper half with a first rib and a lower half with a second rib, the first rib and the second rib together forming the rib of the resin oil strainer, and the filter is sandwiched between the first and second ribs.

7. The baffle plate structure according to claim 1, wherein the inlet portion longitudinally extends in a first direction and the parallel portion longitudinally extends in a second direction, the first direction being substantially perpendicular to the second direction, and wherein the inlet portion longitudinally extends directly below the opening of the baffle plate.

8. The baffle plate structure according to claim 7, wherein a width of the parallel portion in a direction perpendicular to the first direction is greater than a width of the opening of the baffle plate in the direction perpendicular to the first direction.

9. The baffle plate structure according to claim 1, wherein the baffle plate has a substantially H-shaped rib disposed so as to surround the opening.

10. The baffle plate structure according to claim 1, wherein the respective portions of the first end and the second end are disposed at the same height in the height direction of the resin oil strainer with respect to the oil pan.

11. A baffle plate structure comprising:

an oil pan mounted below a crank case, the oil pan having an oil chamber to retain lubricant; an oil pump to draw the lubricant from the oil chamber and to pump the lubricant into an internal-combustion engine;

a baffle plate to separate an interior of the oil pan into a crank case side and an oil chamber side; and a resin oil strainer that allows the lubricant drawn from the oil chamber into the oil pump through the resin oil strainer, the resin oil strainer including an inlet portion and a parallel portion, the inlet portion extending toward a bottom surface of the oil pan to define a height direction of the resin oil strainer, the inlet portion having an inlet port for lubricant at a lower part of the inlet portion, the parallel portion extending from the inlet portion in a direction substantially parallel to the baffle plate to introduce the lubricant from the inlet portion to the oil pump, the resin oil strainer including a rib that protrudes from an interior side of the resin oil strainer towards the baffle plate, wherein the baffle plate has an opening corresponding to the parallel portion of the resin oil strainer, the parallel portion of the resin oil strainer being disposed so as to suppress a flow of the lubricant retained in the oil pan in the direction of an area above the baffle plate and the parallel portion, the rib of the resin oil strainer disposed at a position of the resin oil strainer closest to an edge of the baffle plate surrounding the opening, wherein the parallel portion includes a first end and a second end, the inlet portion extending from the first end toward the bottom surface of the oil pan, the second end being fastened to the oil pump, a lower surface of the first end and a lower surface of the second end being at a same height in the height direction of the resin oil strainer with respect to the baffle plate, wherein the baffle plate further has a rib and a plurality of bolt insertion portions, the rib of the baffle plate surrounding the opening, the plurality of bolt insertion portions comprising portions through which bolts are respectively inserted to fasten the baffle plate to one of the oil pan and the crank case, and wherein the rib of the baffle plate is provided to connect the plurality of bolt insertion portions to each other.

12. The baffle plate structure according to claim 11, wherein the parallel portion is disposed in the opening of the baffle plate.

13. The baffle plate structure according to claim 11, wherein the respective portions of the first end and the second end are disposed at the same height in the height direction of the resin oil strainer with respect to the oil pan.

14. A baffle plate structure comprising:

an oil pan mounted below a crank case, the oil pan having an oil chamber to retain lubricant;

an oil pump to draw the lubricant from the oil chamber and to pump the lubricant into an internal-combustion engine;

a baffle plate to separate an interior of the oil pan into a crank case side and an oil chamber side;

a resin oil strainer that allows the lubricant drawn from the oil chamber into the oil pump through the resin oil strainer, the resin oil strainer including an inlet portion and a parallel portion, the inlet portion extending toward a bottom surface of the oil pan to define a height direction of the resin oil strainer, the inlet portion having an inlet port for lubricant at a lower part of the inlet portion, the parallel portion extending from the inlet portion in a direction substantially parallel to the baffle plate to introduce the lubricant from the inlet portion to the oil pump, the parallel portion comprising an upper half with a first rib, and a lower half with a second rib, the first rib and the second rib together forming a joined rib that protrudes from an interior side of the resin oil strainer towards the baffle plate; and a filter sandwiched between the first and second ribs, wherein the baffle plate has an opening corresponding to the parallel portion of the resin oil strainer, the joined rib of the resin oil strainer disposed at a position of the resin oil strainer closest to an edge of the baffle plate surrounding the opening, and wherein the parallel portion includes a first end and a second end, the inlet portion extending from the first end toward the bottom surface of the oil pan, the second end being fastened to the oil pump, a portion of the first end including the joined rib and a portion of the second end including the joined rib being at a same height in the height direction of the resin oil strainer with respect to the baffle plate.

15. The baffle plate structure according to claim 14, wherein the baffle plate has a rib and a plurality of bolt insertion portions, the rib of the baffle plate surrounding the opening, the plurality of bolt insertion portions comprising portions through which bolts are respectively inserted to fasten the baffle plate to one of the oil pan and the crank case, and wherein the rib of the baffle plate is provided to connect the plurality of bolt insertion portions to each other.

16. The baffle plate structure according to claim 14, wherein the parallel portion is disposed in the opening of the baffle plate.

17. The baffle plate structure according to claim 14, wherein the respective portions of the first end and the second end are disposed at the same height in the height direction of the resin oil strainer with respect to the oil pan.

* * * * *